US011011334B2

(12) United States Patent
Manfreda

(10) Patent No.: US 11,011,334 B2
(45) Date of Patent: May 18, 2021

(54) ELECTROMAGNETIC SWITCH

(71) Applicant: Mahle International GmbH, Stuttgart (DE)

(72) Inventor: Dejan Manfreda, Kal Nad Kanalom (SI)

(73) Assignee: Mahle International GmbH

( * ) Notice: Subject to any disclaimer, the term of this patent is extended or adjusted under 35 U.S.C. 154(b) by 0 days.

(21) Appl. No.: 16/553,416

(22) Filed: Aug. 28, 2019

(65) Prior Publication Data

US 2020/0075280 A1 Mar. 5, 2020

(30) Foreign Application Priority Data

Aug. 28, 2018 (EP) ..... 18191250

(51) Int. Cl.

| | |
|---|---|
| ***H01H 50/44*** | (2006.01) |
| ***F02N 11/08*** | (2006.01) |
| ***H01H 50/42*** | (2006.01) |
| ***H01H 50/20*** | (2006.01) |

(52) U.S. Cl.

CPC ..... *H01H 50/44* (2013.01); *F02N 11/087* (2013.01); *F02N 11/0851* (2013.01); *H01H 50/20* (2013.01); *H01H 50/42* (2013.01)

(58) Field of Classification Search

CPC .... F02N 11/08; F02N 11/0851; F02N 11/087; H01H 50/44; H01H 50/20; H01H 50/42

See application file for complete search history.

(56) References Cited

U.S. PATENT DOCUMENTS

| | | | | |
|---|---|---|---|---|
| 8,248,193 | B2 | 8/2012 | Kaneda et al. | |
| 2011/0260562 | A1 | 10/2011 | Bradfield | |
| 2012/0068475 | A1 | 3/2012 | Bradfield | |
| 2012/0271155 | A1 | 10/2012 | Stemmer | |
| 2014/0240067 | A1 | 8/2014 | Santichen et al. | |
| 2020/0075279 | A1 * | 3/2020 | Manfreda | H01H 51/065 |

FOREIGN PATENT DOCUMENTS

| | | | |
|---|---|---|---|
| DE | 102009052938 | A1 | 11/2010 |
| EP | 3 131 101 | A1 | 2/2017 |

* cited by examiner

*Primary Examiner* — Hieu T Vo

(74) *Attorney, Agent, or Firm* — Fishman Stewart PLLC

(57) ABSTRACT

An electromagnetic switch for a starting device of an internal combustion engine may include a coil carrier having a carrier wall enclosing a cavity, a coil winding, a piston, and a ferromagnetic bypass body. During operation, the coil winding may provide a magnetic field within the cavity. The piston may be disposed in a passive position and may be adjusted axially in a direction of a core. The coil winding may have a coil wire which may be wound around the carrier wall in a first winding direction and an opposing second winding direction. The ferromagnetic bypass body may surround the cavity and may be arranged radially between the cavity and the coil winding. In the passive position of the piston, the bypass body may axially overlap the axial gap. At least one winding of the second winding section may axially overlap the bypass body.

20 Claims, 7 Drawing Sheets

ELECTROMAGNETIC SWITCH

CROSS-REFERENCE TO RELATED APPLICATIONS

This application claims priority to European Patent Application No. EP 18191250.2, filed Aug. 28, 2018, the contents of which are hereby incorporated by reference in its entirety.

TECHNICAL FIELD

The present invention relates to an electromagnetic switch for a starting device, which electromagnetic switch has a coil carrier onto which a coil wire of a coil winding is wound. The invention furthermore relates to a starting device having a switch of said type.

BACKGROUND

For the starting of internal combustion engines, use is commonly made of starting devices. A starting device of said type commonly has a starting element, for example a pinion, which, for the starting of the internal combustion engine, is placed in engagement with a counterpart starting element of the internal combustion engine, for example a ring gear, and drives the latter in order to start the internal combustion engine.

A starting device of said type is known, for example, from DE 10 2009 052 938 A1. The starting device has an electromagnetic switch which has a coil carrier with a holding coil and an adjustment coil or attracting coil wound thereon, which coils are each wound from a coil wire around the coil carrier. During operation, the coils generate a magnetic field within the coil carrier, which magnetic field adjusts a ferromagnetic piston within the coil carrier in the direction of a core. The starting device furthermore has a drive motor which transmits a torque via a pinion to a ring gear of an internal combustion engine in order to start the internal combustion engine. The pinion is placed in engagement with the ring gear, and removed from such engagement, by means of the electromagnetic switch. The electromagnetic switch and the drive motor are in this case connected electrically in series, such that an electrical current flows through the coils in order to generate the magnetic field and subsequently to the drive motor in order to drive the latter.

In the case of such starting devices, it is desirable for sufficient torque for starting the internal combustion engine to be provided. This is normally realized by means of an increase of the electrical current supplied to the drive motor, which in turn leads to a stronger magnetic field in the coil carrier and thus to an increased adjustment force of the piston and ultimately of the pinion in the direction of the ring gear. This increased adjustment force however leads to more intense striking of the pinion against the ring gear, which can lead to damage to the pinion and/or to the ring gear.

It is furthermore desirable for the coil geometry of the electromagnetic switch to be left as far as possible unchanged.

To weaken the magnetic field generated within the coil carrier by means of the coils, DE 10 2009 052 938 A1 proposes that a ferromagnetic bypass body be provided on the coil carrier, which bypass body weakens the magnetic field generated within the coil body by the coils. This has the result that smaller structural spaces are available for the coil winding if it is sought to maintain an unchanged overall geometry. Said document also mentions winding a part of the coil winding in an opposite direction in relation to the rest of the coil winding.

US 2014/0240067 A1 proposes that the piston within the coil carrier be equipped with an encircling groove in order to reduce the influence of the magnetic field on the piston. The non-uniform profile of the shell surface of the piston however leads to non-uniform sliding of the piston within the coil carrier. Furthermore, the maximum possible dimensions of the groove are limited, such that a small reduction of the adjustment force is possible.

From US 2011/0260562 A1, it is known for a lug to be attached to the outside of a coil carrier of an electromagnetic switch, along which lug a coil wire of the coil winding is guided in order for the coil wire to be wound in opposite directions on mutually averted sides of the lug.

EP 3 131 101 A1 has disclosed a coil carrier which, on the outside, is equipped with an encircling separating body with a recess in order for the associated coil wire to be able to be guided through the recess and wound in opposite directions.

SUMMARY

The present invention is concerned with the problem of specifying, for an electromagnetic switch of the above-stated type, and for a starting device having an electromagnetic switch of said type, improved or at least alternative embodiments which are distinguished in particular by an efficient reduction of the magnetic force acting on the piston and/or by a small structural space requirement.

Said object is achieved according to the invention by means of the subjects of the independent claim(s). The dependent claim(s) relate to advantageous embodiments.

The present invention is based on the general concept whereby, in an electromagnetic switch, a ferromagnetic bypass body which encloses a cavity of a coil carrier and which is arranged radially between the cavity and a coil winding is, in a passive position of a piston of the electromagnetic switch, arranged so as to axially overlap an axial gap between the piston and a core of the electromagnetic switch, and furthermore, at least one winding of a coil winding of the electromagnetic switch which is wound in an opposite direction in relation to the rest of the coil winding is arranged so as to axially overlap the bypass body. Here, the ferromagnetic bypass body serves for diverting the magnetic flux or the magnetic field that is generated by the coil winding during operation, that is to say when said coil winding is electrically energized. The at least one winding which is wound in the opposite direction serves for weakening the magnetic field in the cavity. The axially overlapping arrangement of the bypass body between the piston and the core in the passive position of the piston, and the axially overlapping arrangement of the at least one winding wound in the opposite direction with the bypass body, interact synergistically here in order to weaken the magnetic field between the piston and the core in an efficient manner and locally such that, during the operation of the coil winding, the piston is adjusted in the direction of the core with a lower adjustment force.

In accordance with the concept of the invention, the electromagnetic switch has the coil carrier which has a carrier wall extending in an axial direction, which carrier wall encloses the cavity in the coil carrier. The carrier wall is thus in particular of cylindrical form. The piston is arranged in axially adjustable fashion in the cavity of the coil carrier. The coil winding is a coil wire wound on that side of the carrier wall which is averted from the cavity, or said coil winding has a wound coil wire of said type. During operation, the coil winding is flowed through by an electrical current and thereby generates a magnetic field within the cavity, which magnetic field adjusts the piston axially in the cavity. The piston is designed correspondingly for this purpose, for example is at least partially ferromagnetic. Here, the magnetic field generated by the coil winding adjusts the piston in the direction of a core, which is preferably axially fixed and in particular accommodated in the cavity. When the coil winding is not in operation, the piston is situated in the passive position. In said passive position, the axial gap is formed, in the cavity, between the piston and the core in an axial direction. The coil wire is wound in at least two winding sections in opposite winding directions. That is to say, the coil wire is, in a first axial winding section, wound in a first winding direction around the carrier wall. The first winding direction is that which serves for generating a magnetic field for the purposes of adjusting the piston in the direction of the core. In a second axial winding section, the coil wire is furthermore wound in a second winding direction around the carrier wall, wherein the second winding direction is opposite to the first winding direction. According to the invention, the bypass body is, in the passive position, arranged so as to axially overlap the axial gap, and at least one winding of the second winding section is arranged so as to axially overlap the bypass body. The bypass body diverts the magnetic field or the magnetic flux. Here, the bypass body has a saturation limit. The at least one winding of the second winding section which axially overlaps the bypass body reduces the magnetic flux through the bypass body, such that ultimately an increased magnetic flux can flow through the bypass body, until the latter has reached the saturation limit. This leads directly to a reduction of the magnetic field or of the magnetic flux between the piston and the core, such that the adjusting force is correspondingly reduced. Furthermore, the electrical energization of the electromagnetic switch, in particular of the coil winding, can be maintained, such that subsequent applications, in particular a supply of electricity to a downstream motor of an associated starting device for an internal combustion engine, remains unchanged, or, in the case of a reduced adjustment force on the piston, can be increased, such that it remains possible for an equal or increased torque to be transmitted by means of the motor. Said torque is commonly transmitted by means of a starting element of the associated starting device for starting the internal combustion engine to a counterpart starting element of the internal combustion engine, such that the torque required for the starting process remains constant, while the adjustment of the starting element in the direction of the counterpart starting element is reduced, and thus damage to starting element and counterpart starting element is prevented or at least reduced. Secondly, the torque can be increased, without the adjustment force being correspondingly increased.

In the present case, the stated directions relate to the axial direction. Here, axial means in the axial direction or parallel to the axial direction. Radial direction, and radial, mean perpendicular to the axial direction or perpendicular to the axial. The circumferential direction is also to be understood in relation to the axial direction or axial.

The first winding section is to be understood here to mean that section of the coil winding which is wound in the first winding direction and which thus extends axially. The first winding section may in this case furthermore extend radially, for example over two or more radially successive rows of the coil winding. Here, the first winding section may have different axial extents in the different rows. In particular, the first winding section is axially shorter in the row in which the second winding section is also arranged than in other rows.

The second winding section is that section of the coil winding in which the coil wire is wound in the second winding direction. Accordingly, the second winding section extends axially. It is also possible for the second winding section to extend across multiple radially successive rows of the coil winding.

The coil winding expediently has fewer windings in the second winding direction than in the first winding direction.

The switch may in principle have multiple coil windings or coils. In particular, the switch may have an attracting coil for adjusting the piston in the direction of the core and a holding coil for holding the core in one position. The coil winding described here is preferably the attracting coil.

Embodiments are preferable in which at least one winding of the second winding section furthermore axially overlaps the axial gap. Said winding may be the at least one winding which axially overlaps the bypass body. An improved weakening of the magnetic field in the axial gap, and thus between the piston and the core, is thus achieved.

Embodiments have proven to be advantageous in which the bypass body axially entirely overlaps the axial gap. That is, the entire axial length of the bypass body can be in axial overlap with the axial gap. This means in particular that the bypass body extends axially between face sides, which face toward one another and which delimit the axial gap, of the core and of the piston. The action of the bypass body is thus substantially concentrated on and limited to the axial gap, such that the magnetic field in the axial gap and thus between the piston and core is efficiently reduced and confined.

It is alternatively or additionally preferable for all of the windings of the winding section to axially overlap the axial gap. The action of the second winding section is thus locally limited to and concentrated on the axial gap, such that, in turn, effective weakening of the magnetic field between the piston and the core is achieved.

In principle, the bypass body and the second winding section may have any desired axial extents or lengths. In particular, the length of the bypass body may correspond to the length of the second winding section. Here, it is conceivable for the bypass body and the second winding section to be arranged so as to be aligned with one another axially on both sides. This leads to an advantageous interaction between bypass body and second winding section for the weakening of the magnetic field in the axial gap.

Embodiments are preferable in which the bypass body is spaced apart axially from the core. In this way, a magnetic flux from the bypass body to the core is prevented or at least reduced. Consequently, a more effective weakening of the magnetic field between the piston and the core is achieved. An axial distance or clearance between the bypass body and the core is preferably at least 2 mm.

The bypass body arranged radially between the cavity and the coil winding may be accommodated as desired in the switch.

The bypass body is advantageously accommodated in the carrier wall. This leads to simplified assembly of the electromagnetic switch and to an effective reduction of the magnetic field between the piston and the core. Here, the bypass body may be enclosed in a circumferential direction and/or radially by the carrier wall of the coil carrier.

The coil wire may also, in a third axial winding section, be wound in the first winding direction around the carrier wall, wherein the second winding section is arranged axially between the first winding section and the third winding section. This means that the third winding section corresponds to the first winding section, with the difference that, in the row in which the second winding section is arranged, the first winding section and the third winding section are arranged on axially mutually averted sides of the second winding section.

It is self-evident that the subject matter of this invention encompasses not only the electromagnetic switch but also a starting device having an electromagnetic switch of said type.

Further important features and advantages of the invention will emerge from the subclaims, from the drawings and from the associated Figure description based on the drawings.

It is self-evident that the features mentioned above and the features yet to be discussed below may be used not only in the respectively specified combination but also in other combinations or individually without departing from the scope of the present invention.

Preferred exemplary embodiments of the invention are illustrated in the drawings and will be discussed in more detail in the following description, wherein identical reference designations relate to identical or similar or functionally identical components.

BRIEF DESCRIPTION OF THE DRAWINGS

In the drawings, in each case schematically.

DETAILED DESCRIPTION

Figure 9:
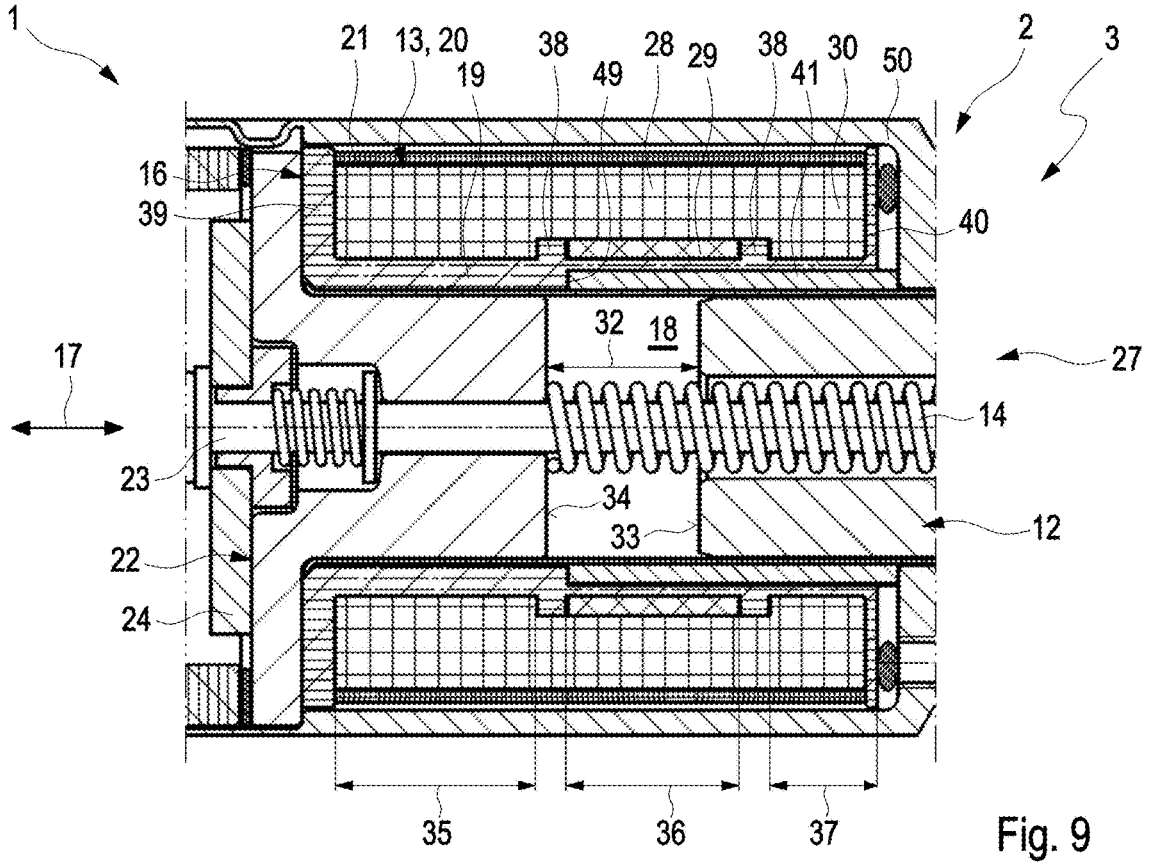
Figure 10:
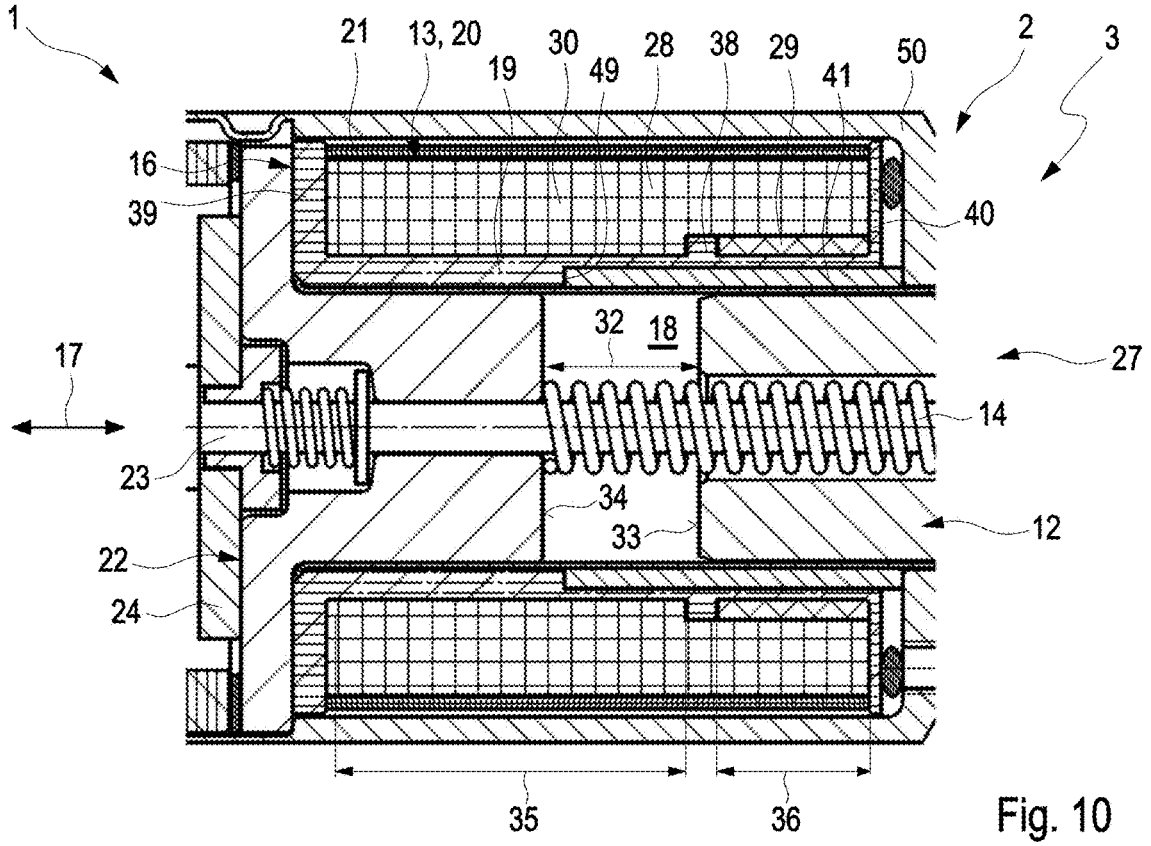
Figure 11:
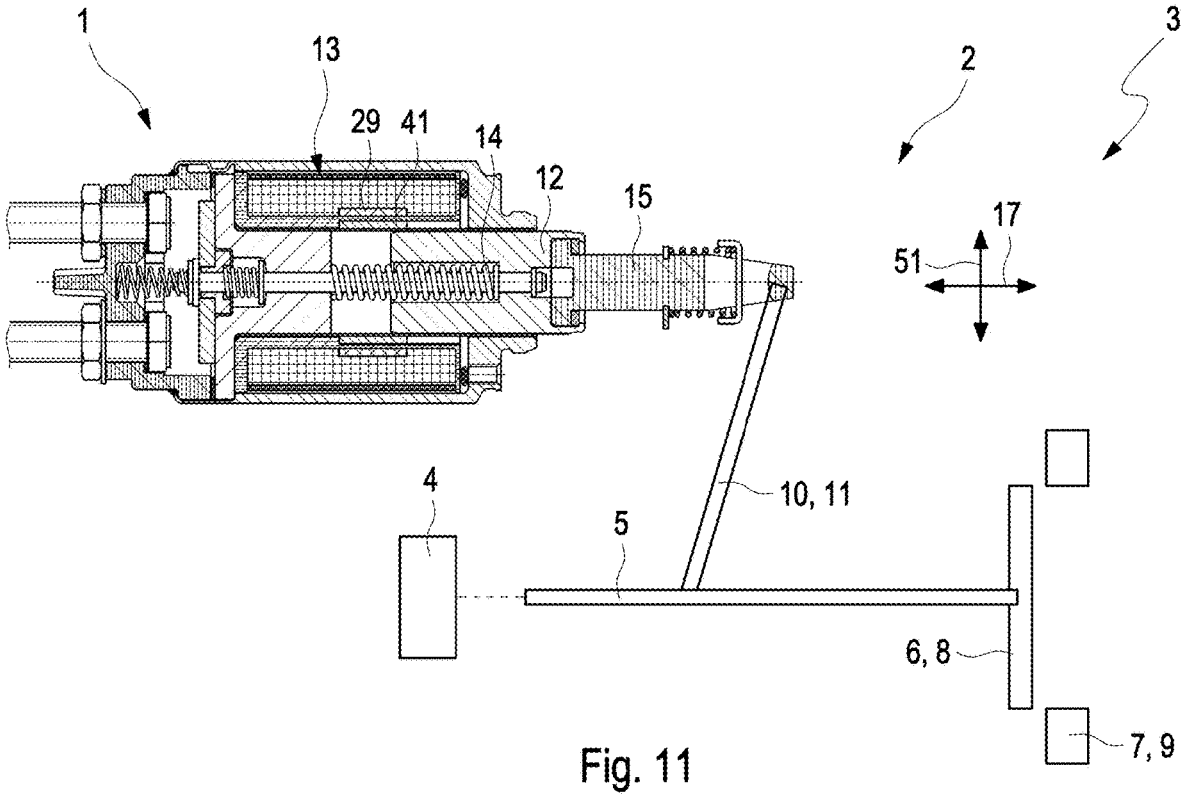
FIG. 11 shows a longitudinal section through a starting device of an internal combustion engine.

An electromagnetic switch 1, hereinafter also referred to for short as switch 1, as shown for example in FIGS. 1 to 11, is commonly a constituent part of a starting device 2 of an internal combustion engine 3, as shown by way of example in FIG. 11. The starting device 2 furthermore has an electrically operated motor 4 or electric motor 4 which, during operation, transmits a torque to a starting element 6 of the starting device 2, for example via a shaft 5, wherein the starting element 6 transmits said torque for starting the internal combustion engine 3 to a counterpart starting element 7. For the transmission of the torque, the starting element 6, which is formed for example as a pinion 8, and the counterpart starting element 7, which is formed for example as a ring gear 9, are placed in engagement. When the internal combustion engine 3 has been started, the engagement of the starting element 6 with the counterpart starting element 7 is released. For this purpose, the starting element 6 is adjustable relative to the counterpart starting element 8. This adjustment is realized by means of the electromagnetic switch 1, which adjusts the starting element 6 via a coupling element 10, for example a lever 11. The coupling element 10 is connected in terms of drive to a piston 12 of the starting device 2 and is mounted such that an adjustment of the piston 12 in one axial direction 17 axially adjusts the starting element 6 in the opposite direction. For this purpose, the piston 12 is adjustable in the starting device 2 in the axial direction 17, and is thus axially adjustable, wherein the adjustment of the piston 12 in the axial direction 17 for the displacement of the starting element 6 in the direction of the counterpart starting element 7 is realized by means of a coil winding 13, and the adjustment of the starting element 6 away from the counterpart starting element 7 is realized by means of at least one spring 14 which acts on the piston 12. In the example shown, the piston 12 is in this case connected by means of a bolt 15, which is attached to the piston 12, to the coupling element 10.

The switch 1 has a coil carrier 16 which has a carrier wall 19, which carrier wall extends in cylindrical form in an axial direction 17 and encloses a cavity 18, and on which carrier wall the coil winding 13 is wound. In the example shown, the coil winding 13 extends from a radially projecting first end wall 39 to a radially projecting second end wall 40, which is situated axially opposite the first end wall 39, of the coil carrier 16. The end walls 39, 40 run in each case in closed form in a circumferential direction and are of disk-like form. Here, the coil winding 13 forms an attracting coil 20 of the switch 1. In the examples shown, the switch 1 furthermore has a holding coil 21, which is wound radially outside the coil winding 13. The coil winding 13 and the holding coil 21 are arranged in a housing 50 of the switch 1. When electrically energized, the coil winding 13 or the attracting coil 20 serves for the adjustment of the piston 12 in the direction of a core 22, which, like the piston 12, is accommodated in the cavity 18 but is fixed therein and is thus axially non-adjustable. For this purpose, during operation, that is to say when energized, the coil winding 13 and thus the attracting coil 20 and the holding coil 21 generate, within the cavity 18, a magnetic field which exerts an adjusting force on the piston 12 and thus adjusts said piston axially in the direction of the core 22. For this purpose, the piston 12 is at least partially, preferably entirely, ferromagnetic. With the holding coil 21, it is possible to hold the piston 12 in its respectively present position. The attracting coil 20 and the holding coil 21 in this case generate such a magnetic field, which subjects the piston 2 to an adjusting force opposed to the spring force of the at least one spring 14, such that, for the adjustment of the piston 12 in the direction of the core 22, the spring force is overcome, and for the holding of the piston 12 in its present position, a compensation of the spring force is realized. The piston 12 is mechanically connected, by means of a connecting element 23 which is of rod-like form in the example shown, to a switching element 24. During the adjustment of the piston 12 in the direction of the core 12, which is likewise at least partially ferromagnetic, the switching element 24 is adjusted in the direction of electrical contacts 25, wherein the switching element 24, when it makes contact with the electrical contacts 25, electrically connects said contacts 25 to one another. Thus, an electrical connection is produced between two lines 26 by means of which electricity is supplied to the electric motor 4. Here, for the starting of the internal combustion engine 3, the coils 20, 21 are electrically energized, and here, adjust the piston 12 in the direction of the core 22 until the switching element 24 produces an electrical connection between the electrical contacts 25. In this state, the electrical energization of the attracting coil 13 is stopped, and the holding coil 21 is electrically energized, in order to hold the piston 12 in position and thus maintain an electrical connection between the lines 26 that supply electricity to the electric motor 4. In this position, it is furthermore the case that the starting element 6 and the counterpart starting element 7 are in engagement, such that the electric motor 4 starts the internal combustion engine 3. When the internal combustion engine 3 has been started, the supply of electricity to the starting device 1 is stopped, such that no magnetic field is generated, and the spring force adjusts the piston 12 back into a passive position 27, which is illustrated in FIGS. 1 to 11. The passive position 27 of the piston 12 is thus the position in the absence of electrical energization of the electromagnetic switch 1. The starting device 2 is in this case connected such that the electrical current that flows through the switch 1 corresponds to the current by means of which the electric motor 4 is driven. The magnetic field which is generated by the attracting coil 20, and thus the adjusting force that acts on the piston 12, and also the torque that is transmitted by means of the electric motor 4 to the starting element 6, are thus dependent on said electrical current. Here, there is a demand firstly to keep the torque of the electric motor 4 sufficiently high, or to increase said torque, such that the internal combustion engine 3 can be started in simplified fashion. Secondly, it is sought to reduce the adjusting force with which the piston 12 is adjusted in the direction of the core 22, in order to reduce damage to the starting element 6 and/or to the counterpart starting element 7, such as can arise during the production of the engagement of the starting element 6 with the counterpart starting element 7.

In the examples shown, the coil wire 30 of the coil winding 13 is wound in multiple radially successive rows 31. Here, the row 31' situated closest to the cavity 18 is referred to as first row 31'.

In the passive position 27, the piston 12 is separated from the core 22 by an axial gap 32 running in an axial direction 17, which axial gap extends axially between a face side 33, facing toward the core 22, of the piston 12, hereinafter also referred to as piston face side 33, and a face side 34, facing toward the piston 12, of the core 22, hereinafter also referred to as core face side 34.

To reduce the adjusting force, the electromagnetic switch 1 has a bypass body 41, which encloses the cavity 18 and which is arranged radially between the cavity 18 and the coil winding 13. Here, the bypass body 41 is, in the passive position 27 of the piston 12, arranged so as to axially overlap the axial gap 32. Furthermore, the coil winding 13, which forms the attracting coil 20, is wound at least partially oppositely to the winding direction 28 with which the coil winding 13, when electrically energized, adjusts the piston 12 in the direction of the core 22, hereinafter referred to as first winding direction 28, specifically is wound in a second winding direction 29. A coil wire 30 of the coil winding 13 is thus wound partially in the first winding direction 28 and partially in the second winding direction 29, wherein the different winding directions 28, 29 are illustrated or indicated in FIGS. 1 to 11 by means of different hatchings of the coil winding 13. Here, the coil wire 30 is, in a first axial winding section 35, wound in the first winding direction 28 around the carrier wall 19 and, in a second axial winding section 36, is wound in the second winding direction 29 around the carrier wall 19.

Here, the first winding section 35 is to be understood to mean that section of the coil winding 13 which is wound in the first winding direction 28 and thus extends axially. The second winding section 36 is that section of the coil winding 13 in which the coil wire 30 is wound in the second winding direction 29. Accordingly, the second winding section 36 extends axially. It is also possible for the second winding section to extend across multiple radially successive rows 31 of the coil winding 13.

In the examples of FIGS. 1, 2, 4, 5, 7 and 9, the coil wire 30 is furthermore, in a third axial winding section 37, likewise wound in the first winding direction 28 around the carrier wall 19, wherein the second winding section 36 is arranged axially between the first winding section 35 and the third winding section 37. The third winding section 37 thus corresponds to the first winding section 35, with the difference that, in the row 31 in which the second winding section 36 is arranged, the first winding section 35 and the third winding section 37 are arranged on axially mutually averted sides of the second winding section 36.

Here, at least one winding of the second winding section 36 is arranged so as to axially overlap the bypass body 41. In the example shown in FIGS. 1 and 2, the second winding section 29 is arranged so as to axially entirely overlap the bypass body 41, wherein bypass body 41 and second winding section 36 have substantially the same length in the axial direction 17, and are aligned with one another axially on both sides.

Figure 1:
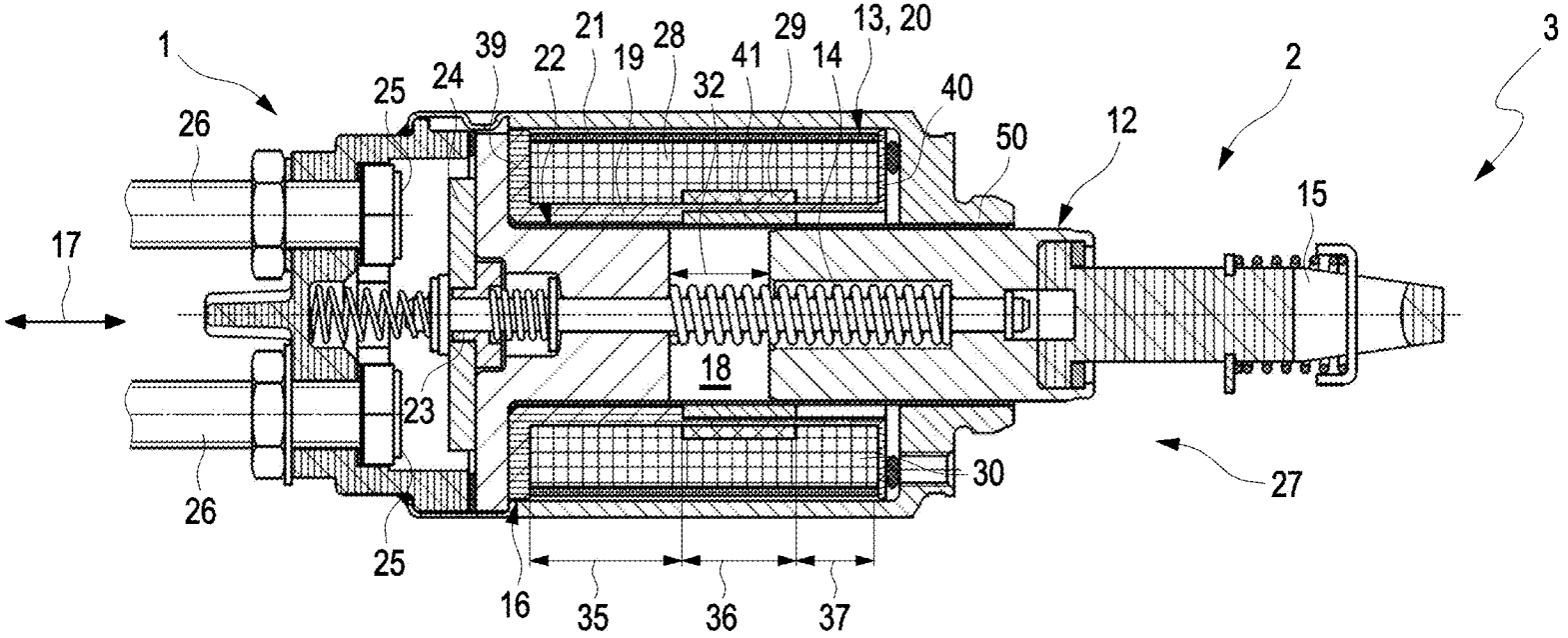
FIG. 1 shows a longitudinal section through an electromagnetic switch.
Figure 2:
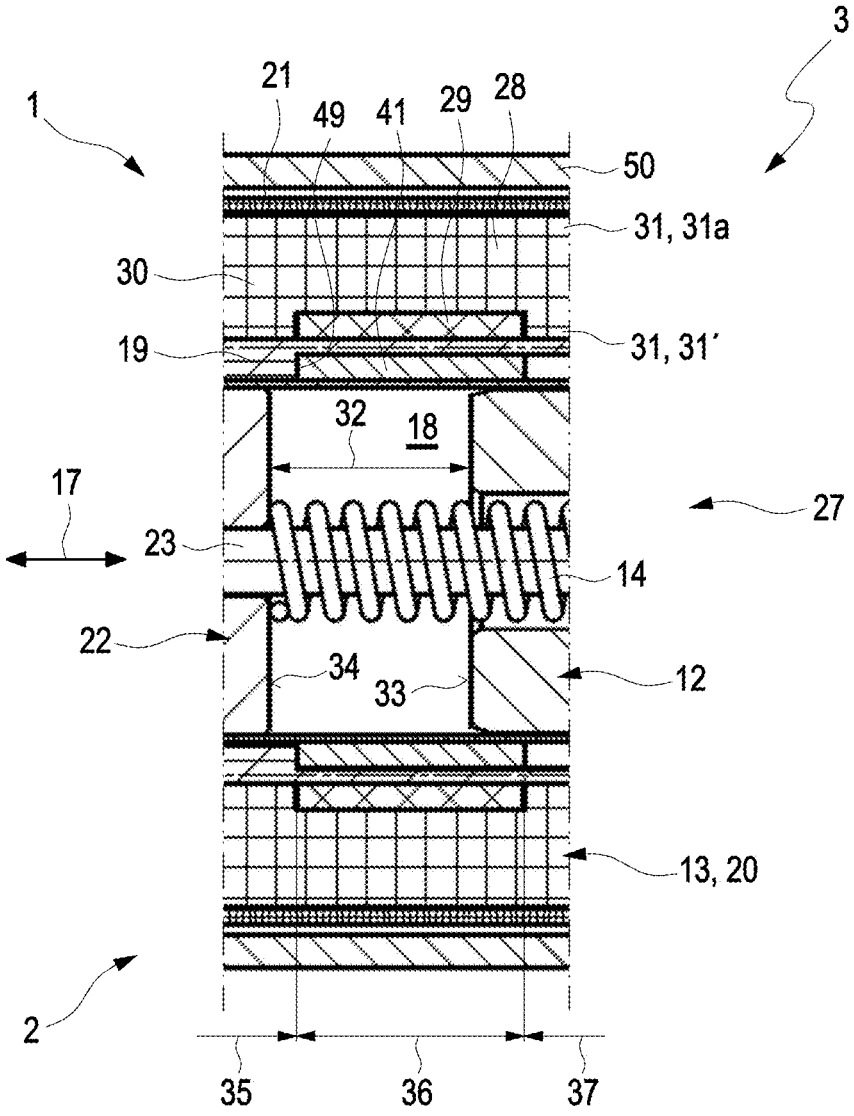
FIG. 2 is an enlarged illustration from FIG. 1.
Figure 3:
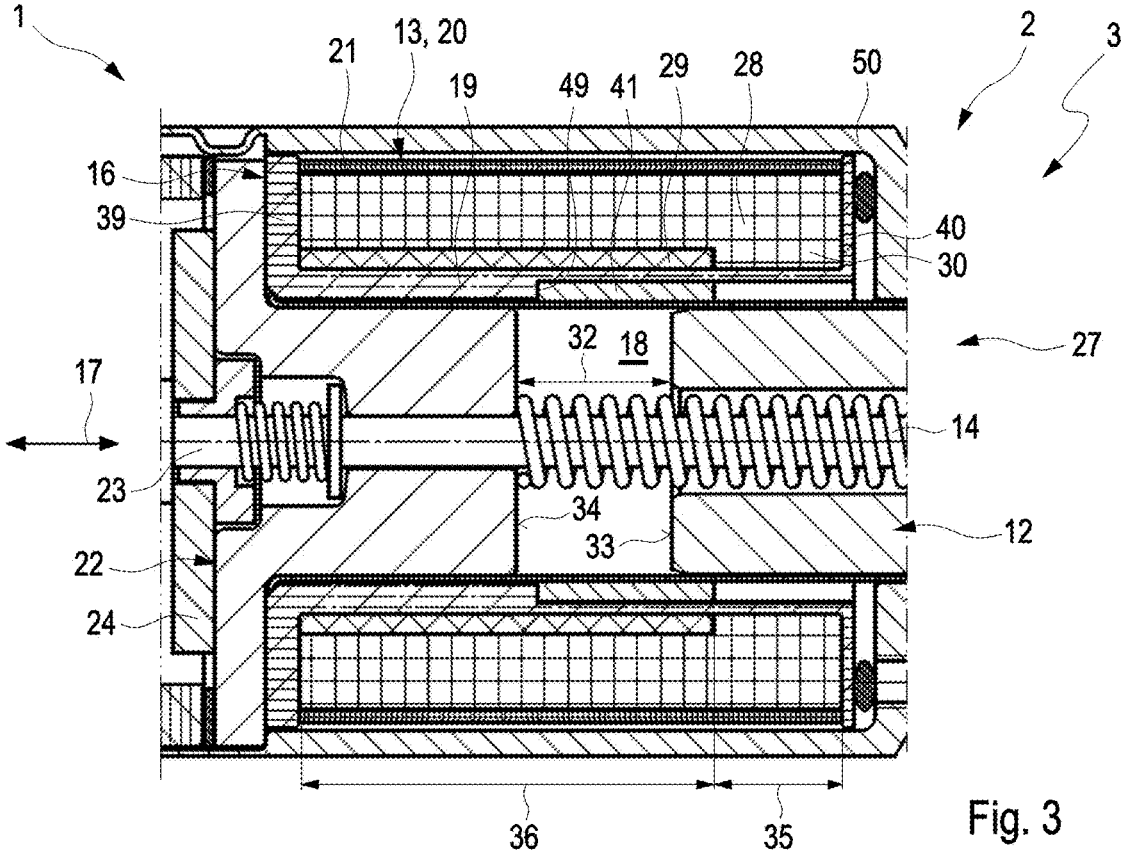
FIGS. 3 through 10 each show a longitudinal section through the switch, in each case in a different embodiment.

The exemplary embodiment shown in FIG. 3 differs from the example shown in FIGS. 1 and 2 in that the second winding section 36 has been extended toward the first end wall 39, such that the second winding section 36 extends as far as the first end wall 39. Thus, in this example, the coil winding 13 has the second winding section 36 and the first winding section 35. The second winding section 36 thus also axially overlaps the core 22.

Figure 4:
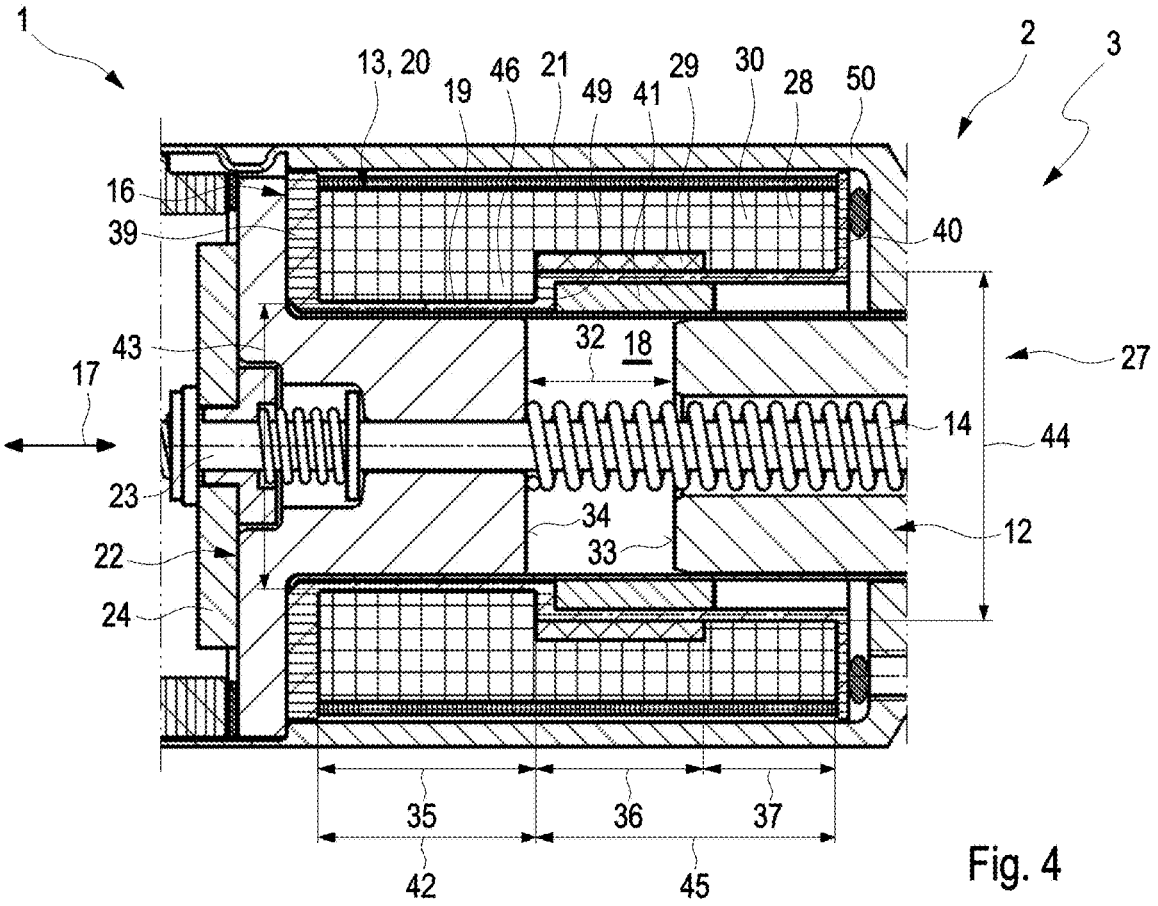

FIG. 4 shows a further exemplary embodiment of the switch 1. This exemplary embodiment differs from the exemplary embodiment shown in FIGS. 1 and 2 in that the bypass body 41 is dimensioned to be radially larger, and is thus thicker. Furthermore, by comparison with the example shown in FIGS. 1 and 2, the second winding section 36 has been relocated toward the core 22. Both the bypass body 41 and the second winding section 36 are in each case arranged so as to axially overlap one another and the axial gap 32. The carrier wall 19 is equipped with a radial step, such that said carrier wall, in an axially running first wall section 42, has an outer diameter 43, hereinafter referred to as first outer diameter 43, which is smaller than an outer diameter 44 in an axially adjoining second wall section 45, hereinafter referred to as second outer diameter 44. Therefore, the carrier wall 19 has, in the first wall section 42, a chamber 46 which is recessed toward the cavity 18. In the example shown, the chamber 46 is filled with coil wire 30 wound in the first winding direction 18. Axially adjacent to the chamber 46, the coil wire 30 is wound in the second winding direction 29, such that the second winding section 36 is wound on the second wall section 45. That side of the second winding section 36 which is axially averted from the chamber 6 is adjoined by the third winding section 37. In this exemplary embodiment, too, the second winding section 36 is, in the region in which it is arranged, arranged radially as close as possible to the axial gap 32. This means that that side of the second winding section 36 which faces radially toward the cavity 18 or the axial gap 32 is free from the coil wire 30.

Figure 5:
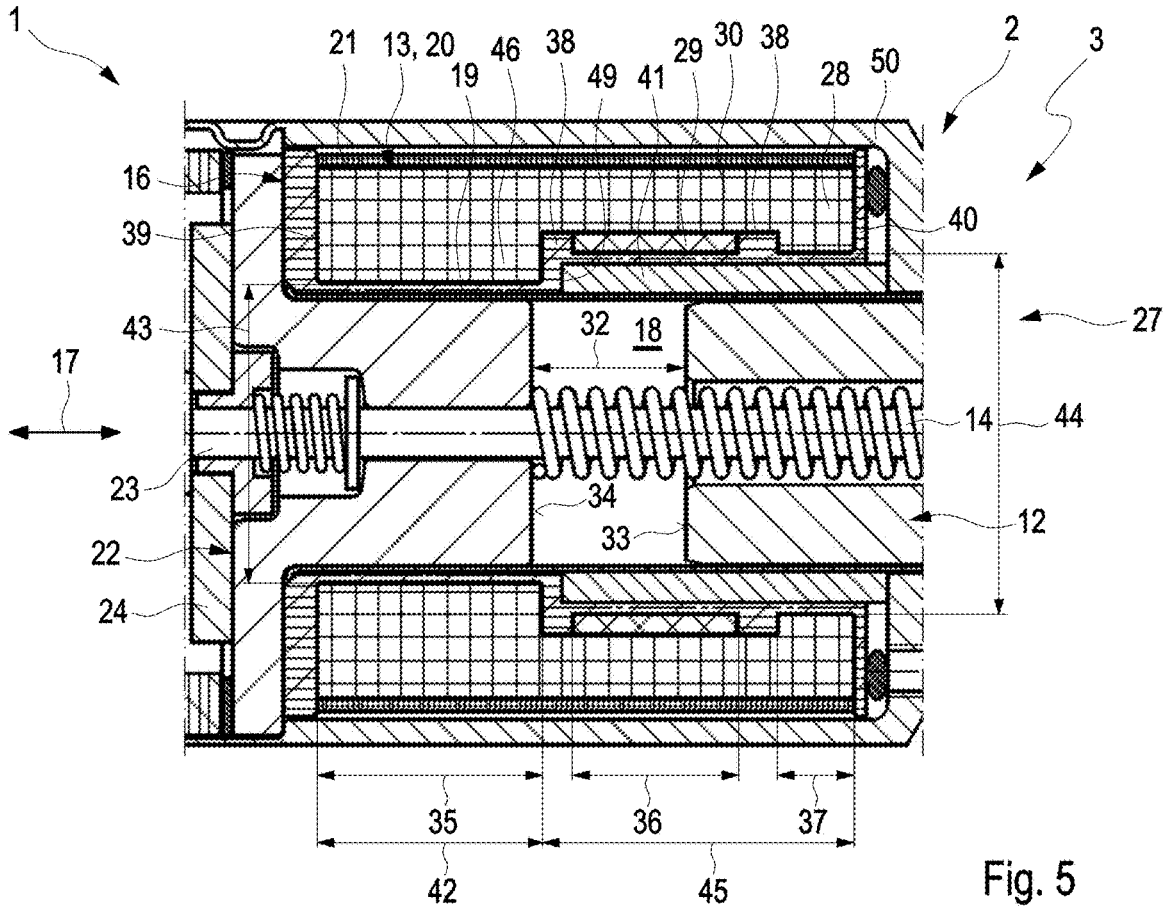

A further exemplary embodiment of the switch 1 is illustrated in FIG. 5. This exemplary embodiment differs from the example shown in FIG. 4 in that the bypass body 41 extends toward the piston 12 and, here, is formed so as to be larger in the axial direction 17 than the second winding section 36. Furthermore, the coil carrier 16 is equipped with two separating bodies 38, which separate the second winding section 36 in each case from the third winding section 37 or from the first winding section 35.

Figure 6:
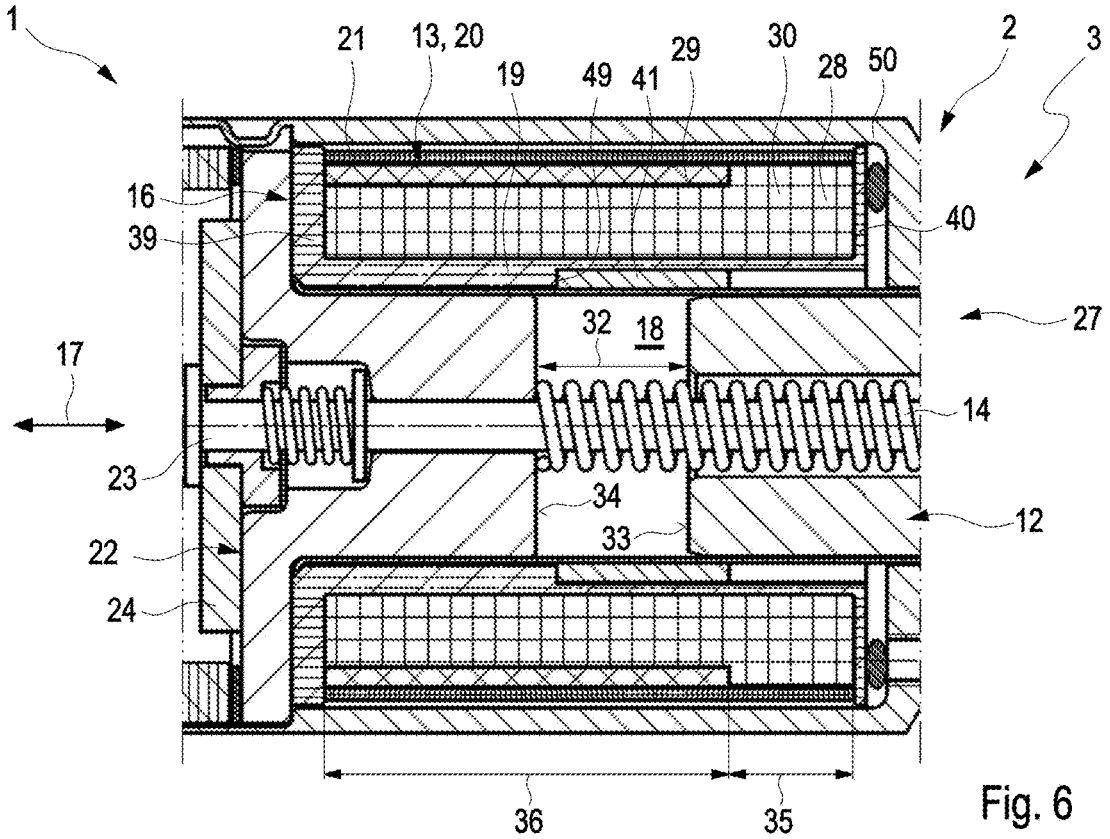

The exemplary embodiment shown in FIG. 6 differs from the example shown in FIG. 3 in that the second winding section 36 is arranged not in the first row 31' but in the row 31 situated radially furthest remote from the axial gap 32 or from the cavity 18, hereinafter also referred to as last row 31*a*, of the coil winding 13.

Figure 7:
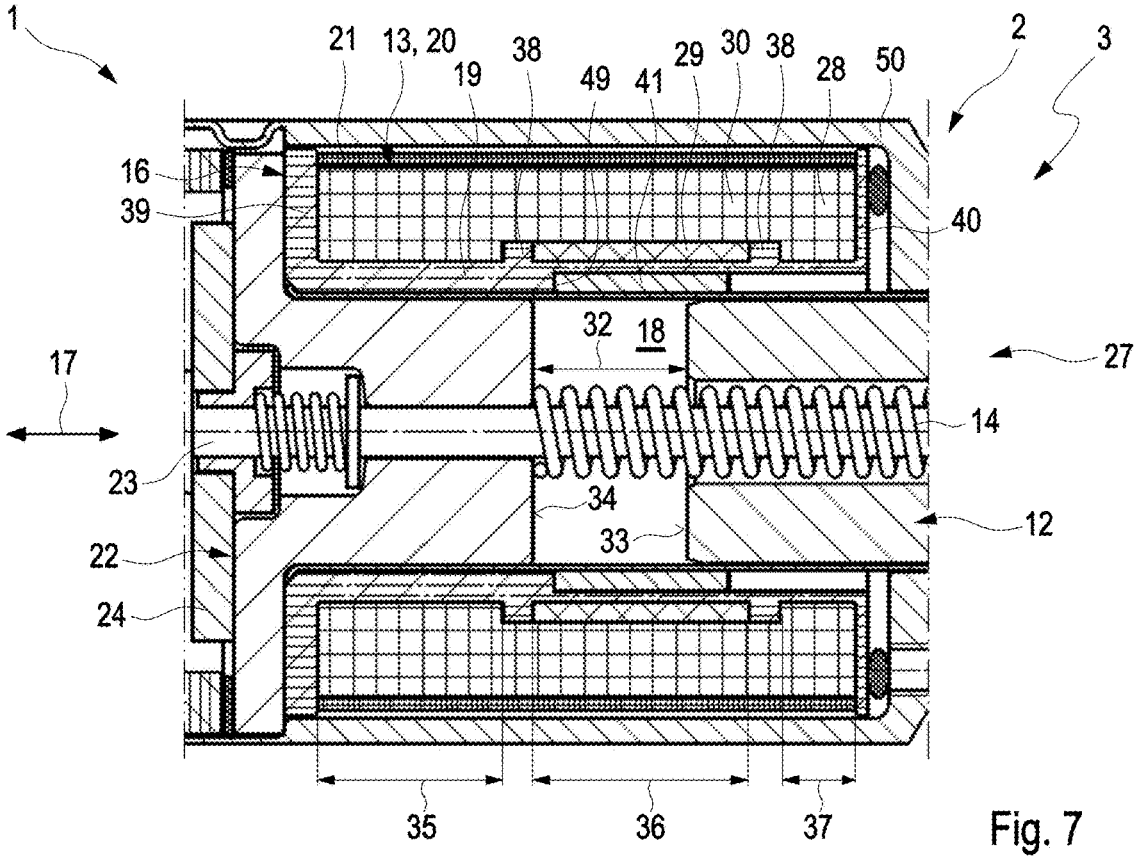

In the exemplary embodiment shown in FIG. 7, in relation to the exemplary embodiment shown in FIG. 5, the bypass body 41 is thinner, and has in particular a radially running thickness which corresponds to the examples in FIGS. 1 to 3. Here, the second winding section 36 is larger, that is to say longer, in the axial direction 17 than the bypass body 41. The bypass body 41 is, in the axial direction, arranged approximately centrally in relation to the second winding section 36. Furthermore, by contrast to the example in FIG. 5, no chamber 46 is provided.

Figure 8:
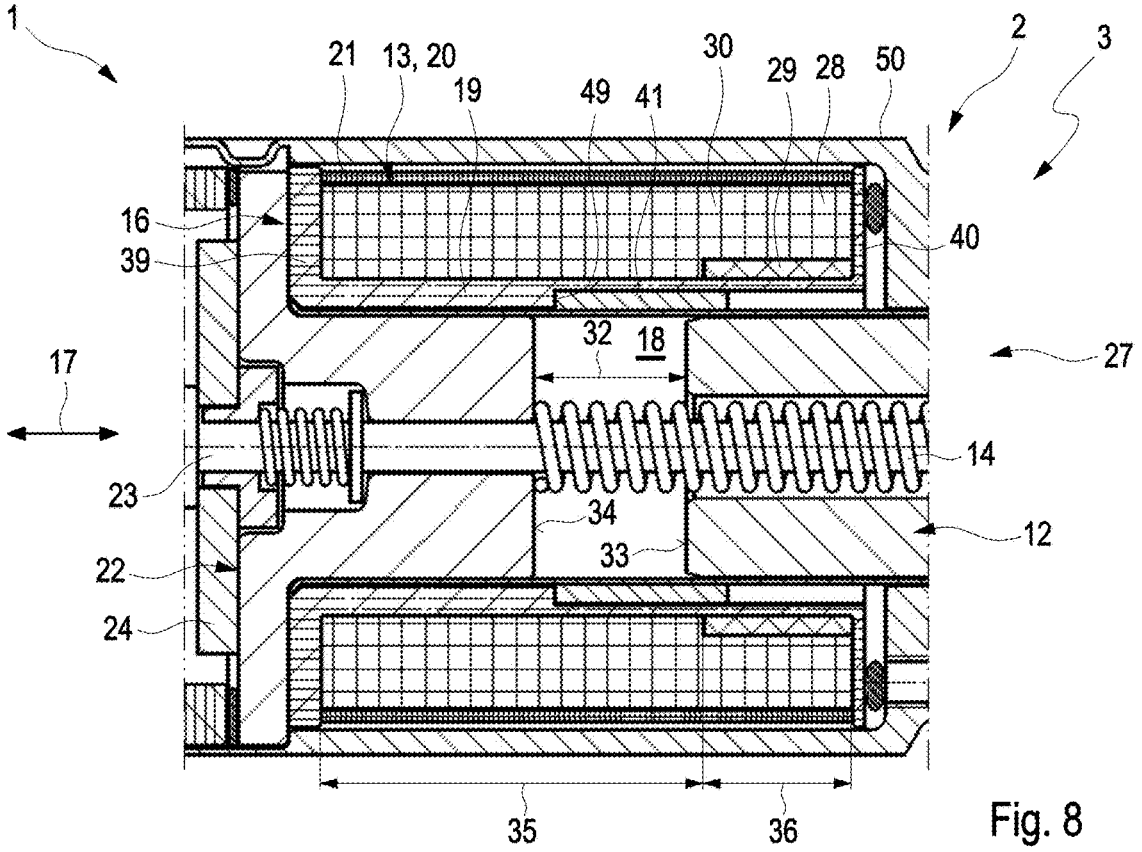

FIG. 8 shows an exemplary embodiment which differs from the example shown in FIGS. 1 and 2 in that the second winding section 36 has no axial overlap with the axial gap 32, but axially overlaps the bypass body 41. Here, the second winding section 36 has been relocated toward the second end wall 40, and extends axially as far as the second end wall 40 of the coil carrier 16.

The exemplary embodiment shown in FIG. 9 corresponds to the example shown in FIG. 7, with the difference that the bypass body 41 extends axially in the direction of the piston 12 and projects axially beyond the coil carrier 16. Furthermore, the second winding section 29 is spaced apart from the core 22 with the same axial spacing as the bypass body 41.

The exemplary embodiment shown in FIG. 10 differs from the example shown in FIG. 9 in that the second winding section 36 has no axial overlap with the axial gap 32, and has been relocated toward the piston 12 and the second end wall 40 of the coil carrier 16. Here, the second winding section 36 extends from a separating body 38 to the second end wall 40.

In the examples shown, the bypass body 41 is accommodated by means of the coil carrier 16. For this purpose, the coil body 16 has an axial shoulder 49 which extends in a circumferential direction. Here, the bypass body 41 is surrounded in form-fitting fashion by the carrier wall 19 or the shoulder 49.

In the example shown in FIGS. 4 and 5, the chamber 46, or the difference between the outer diameters 43, 44, is also realized by means of said shoulder 49. In the examples of FIGS. 5, 9 and 10, the bypass body 41 is, on the side averted from the shoulder 49, furthermore surrounded axially in form-fitting fashion by the housing 50. In other words, on the side averted from the shoulder 49, the bypass body 41 abuts axially against the housing 50. By contrast, in the other examples, the bypass body 41 is axially spaced apart from the housing 50.

In all of the examples shown, the bypass body 41 is furthermore spaced apart axially from the core 22.

The invention claimed is:

1. An electromagnetic switch for a starting device of an internal combustion engine, comprising:

a coil carrier having a carrier wall which extends in an axial direction and encloses a cavity in the coil carrier;

a coil winding having a coil wire wound on a side of the carrier wall facing away from the cavity and which, during operation, is flowed through by an electrical current and provides a magnetic field within the cavity;

a piston which is axially adjustable in the cavity and which, when the coil winding is not in operation, is in a passive position and, during operation of the coil winding, is adjusted axially in a direction of a core;

in the passive position of the piston, an axial gap extending in the cavity between the piston and the core;

the coil wire, in an axially extending first winding section, wound in a first winding direction around the carrier wall;

the coil wire, in an axially extending second winding section, wound in a second winding direction opposite the first winding direction around the carrier wall;

a ferromagnetic bypass body surrounding the cavity, the bypass body arranged radially between the cavity and the coil winding;

wherein, in the passive position of the piston, the bypass body axially overlaps the axial gap; and wherein at least one winding of the second winding section axially overlaps the bypass body.

2. The electromagnetic switch according to claim 1, wherein the bypass body axially overlaps the axial gap entirely.

3. The electromagnetic switch according to claim 1, wherein the second winding section includes a plurality of windings, and wherein each of the plurality of windings of the second winding section axially overlap the axial gap.

4. The electromagnetic switch according to claim 1, wherein the bypass body and the second winding section are aligned with one another axially on both sides.

5. The electromagnetic switch according to claim 1, wherein the bypass body is arranged spaced apart axially from the core.

6. The electromagnetic switch according to claim 1, wherein the bypass body is accommodated in the carrier wall.

7. The electromagnetic switch according to claim 6, wherein the bypass body is enclosed by the carrier wall.

8. The electromagnetic switch according to claim 1, wherein the coil wire is, in a third axial winding section, wound in the first winding direction around the carrier wall, and wherein the second winding section is arranged axially between the first winding section and the third winding section.

9. A starting device for starting an internal combustion engine, comprising:

a starting element which, for the starting of the internal combustion engine, engages a counterpart starting element of the internal combustion engine; and an electromagnetic switch including:

a coil carrier having a carrier wall which extends in an axial direction and encloses a cavity in the coil carrier;

a coil winding having a coil wire wound on a side of the carrier wall facing away from the cavity and which, during operation, is flowed through by an electrical current and provides a magnetic field within the cavity;

a piston which is axially adjustable in the cavity and which, when the coil winding is not in operation, is in a passive position and, during operation of the coil winding, is adjusted axially in a direction of a core;

in the passive position of the piston, an axial gap extending in the cavity between the piston and the core;

the coil wire, in an axially extending first winding section, wound in a first winding direction around the carrier wall;

the coil wire, in an axially extending second winding section, wound in a second winding direction opposite the first winding direction around the carrier wall;

a ferromagnetic bypass body surrounding the cavity, the bypass body arranged radially between the cavity and the coil winding;

the bypass body, in the passive position of the piston, axially overlapping the axial gap; and at least one winding of the second winding section axially overlapping the bypass body;

wherein the piston is connected to the starting element such that the piston, during the axial adjustment in the direction of the core, adjusts the starting element in a direction of the counterpart starting element.

10. The starting device according to claim 9, wherein at least one winding of the second winding section axially overlaps the axial gap.

11. The starting device according to claim 9, wherein the bypass body axially overlaps the axial gap entirely.

12. The starting device according to claim 9, wherein the second winding section includes a plurality of windings, and wherein each of the plurality of windings of the second winding section axially overlap the axial gap.

13. The starting device according to claim 9, wherein the bypass body and the second winding section are aligned with one another axially on both sides.

14. The starting device according to claim 9, wherein the bypass body is arranged spaced apart axially from the core.

15. The starting device according to claim 9, wherein the bypass body is accommodated in the carrier wall.

16. The starting device according to claim 15, wherein the bypass body is enclosed by the carrier wall.

17. The starting device according to claim 9, wherein the coil wire is, in a third axial winding section, wound in the first winding direction around the carrier wall, and wherein the second winding section is arranged axially between the first winding section and the third winding section.

18. An electromagnetic switch for a starting device of an internal combustion engine, comprising:

a coil carrier having an axially extending carrier wall circumferentially enclosing a cavity within the coil carrier;

a coil winding having a coil wire wound on a side of the carrier wall facing away from the cavity and which, during operation, is flowed through by an electrical current and provides a magnetic field within the cavity;

an axially adjustable piston disposed in a passive position when the coil winding is not in operation and which is axially adjusted within the cavity in a direction of the core during operation of the coil winding;

the piston and the core defining an axial gap therebetween within the cavity when the piston is in the passive position;

the coil wire having an axially extending first winding section and an axially extending second winding section, the first winding section wound around the carrier wall in a first winding direction, the second winding section wound around the carrier wall in a second winding direction opposite the first winding direction;

a ferromagnetic bypass body surrounding the cavity, the bypass body accommodated in the carrier wall and arranged radially between the cavity and the coil winding;

wherein the bypass body axially overlaps the axial gap when the piston is in the passive position; and wherein at least one winding of the second winding section axially overlaps the bypass body and the axially gap.

19. The electromagnetic switch according to claim 18, wherein the coil wire has a third axial winding section wound around the carrier wall in the first winding direction, and wherein the second winding section is arranged axially between the first winding section and the third winding section in axial alignment with the bypass body.

20. The electromagnetic switch according to claim 19, wherein the bypass body is arranged spaced apart axially from the core and is enclosed by the carrier wall.

* * * * *